US006685615B2

(12) United States Patent
Weder

(10) Patent No.: US 6,685,615 B2
(45) **Date of Patent: *Feb. 3, 2004**

(54) CORRUGATED DECORATIVE GRASS FORMED OF PAPER AND POLYMERIC FILM AND METHOD FOR PRODUCING SAME

(75) Inventor: Donald E. Weder, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 149 days.

This patent is subject to a terminal disclaimer.

(21) Appl. No.: 10/035,760

(22) Filed: Nov. 7, 2001

(65) Prior Publication Data

US 2002/0119277 A1 Aug. 29, 2002

Related U.S. Application Data

(63) Continuation-in-part of application No. 09/779,927, filed on Feb. 8, 2001, now Pat. No. 6,365,241.

(51) Int. Cl.[7] ..... B31F 1/20

(52) U.S. Cl. ..... 493/463; 493/459; 493/967

(58) Field of Search ..... 493/463, 464, 493/459, 409, 967

(56) References Cited

U.S. PATENT DOCUMENTS

| | | | |
|---|---|---|---|
| 2,016,334 | A | 10/1935 | McComb |
| 2,141,235 | A | 12/1938 | Angeletti |
| 2,244,845 | A | 6/1941 | Matthews |
| 2,336,100 | A | 12/1943 | Jacques et al. |
| 2,399,744 | A | 5/1946 | Kaphan |
| 2,679,887 | A | 6/1954 | Doyle et al. |
| 3,398,434 | A | 8/1968 | Alesti, Jr. et al. |
| 3,416,991 | A | 12/1968 | Yoshimura |
| 3,459,845 | A | 8/1969 | Hebeler |
| 3,503,292 | A | 3/1970 | Kingberg |
| 3,558,580 | A | 1/1971 | Orser |
| 3,607,583 | A | 9/1971 | Geschwender |
| 3,650,877 | A | 3/1972 | Johnson |
| 3,673,056 | A | 6/1972 | Nadler |
| 3,803,284 | A | 4/1974 | Burghardt |
| 3,869,533 | A | 3/1975 | Jonocha et al. |
| 3,898,117 | A | 8/1975 | Taylor |
| 3,933,959 | A | 1/1976 | Skochdopole et al. |
| 4,012,932 | A | 3/1977 | Gewiss |
| 4,045,949 | A | 9/1977 | Paton et al. |
| 4,056,646 | A | 11/1977 | Westfall et al. |
| 4,132,155 | A | 1/1979 | Hicks et al. |
| 4,199,627 | A | 4/1980 | Weder et al. |
| 4,255,487 | A | 3/1981 | Sanders |
| 4,292,266 | A | 9/1981 | Weder et al. |
| 4,359,442 | A | 11/1982 | Cleminson et al. |
| 4,385,087 | A | 5/1983 | Roberts et al. |
| 4,401,700 | A | 8/1983 | Weder et al. |
| 4,496,614 | A | 1/1985 | Weder et al. |
| 4,549,908 | A | 10/1985 | Weder et al. |
| 4,735,669 | A | 4/1988 | Guida et al. |
| 4,989,396 | A | 2/1991 | Weder et al. |
| 5,088,972 | A | 2/1992 | Parker |
| 5,105,599 | A | 4/1992 | Weder |
| 5,111,637 | A | 5/1992 | Weder et al. |
| 5,134,013 | A | 7/1992 | Parker |
| 5,173,352 | A | 12/1992 | Parker |
| 5,403,259 | A | 4/1995 | Parker |
| 5,492,584 | A | 2/1996 | Bateman |
| D368,654 | S | 4/1996 | Santoiemmo et al. |
| 5,573,491 | A | 11/1996 | Parker |
| 5,625,979 | A | 5/1997 | Weder |

(List continued on next page.)

*Primary Examiner*—Eugene Kim
*Assistant Examiner*—Sameh H. Tawfik
(74) *Attorney, Agent, or Firm*—Dunlap, Codding & Rogers, P.C.

(57) ABSTRACT

The present invention discloses folded corrugated materials for producing segments or strips for use as Easter grass, packing material and the like wherein the folded corrugated materials are formed of paper and polymeric film.

15 Claims, 4 Drawing Sheets

U.S. PATENT DOCUMENTS

| | | | | |
|---|---|---|---|---|
| 5,656,008 | A | | 8/1997 | Beierlorzer |
| 5,656,233 | A | | 8/1997 | Weder et al. |
| 5,678,288 | A | | 10/1997 | Walton et al. |
| 5,694,741 | A | | 12/1997 | Weder et al. |
| 5,711,752 | A | | 1/1998 | Goldstein |
| 5,712,020 | A | | 1/1998 | Parker |
| 5,802,813 | A | | 9/1998 | Weder |
| 5,871,432 | A | | 2/1999 | Beierlorzer |
| 5,906,569 | A | | 5/1999 | Ratzel |
| 5,921,907 | A | | 7/1999 | Beierlorzer |
| 6,190,783 | B1 | * | 2/2001 | Weder ..... 428/542.2 |
| 6,221,000 | B1 | * | 4/2001 | Weder ..... 493/463 |
| 6,365,241 | B2 | * | 4/2002 | Weder ..... 428/17 |
| 6,402,675 | B2 | * | 6/2002 | Weder ..... 493/463 |

* cited by examiner

CORRUGATED DECORATIVE GRASS FORMED OF PAPER AND POLYMERIC FILM AND METHOD FOR PRODUCING SAME

CROSS REFERENCE TO RELATED APPLICATIONS

This application is a continuation-in-part of U.S. Ser. No. 09/779,927, now U.S. Pat. No. 6,365,241 entitled "FOLDED CORRUGATED DECORATIVE GRASS FORMED OF PAPER AND POLYMERIC FILM", filed Feb. 8, 2001.

STATEMENT REGARDING FEDERALLY SPONSORED RESEARCH OR DEVELOPMENT

Not applicable.

FIELD OF THE INVENTION

The present invention relates to corrugated materials and methods for producing same, and more particularly but not by way of limitation, to decorative grass made from such folded corrugated materials.

DETAILED DESCRIPTION OF THE INVENTION

Figure 1A:
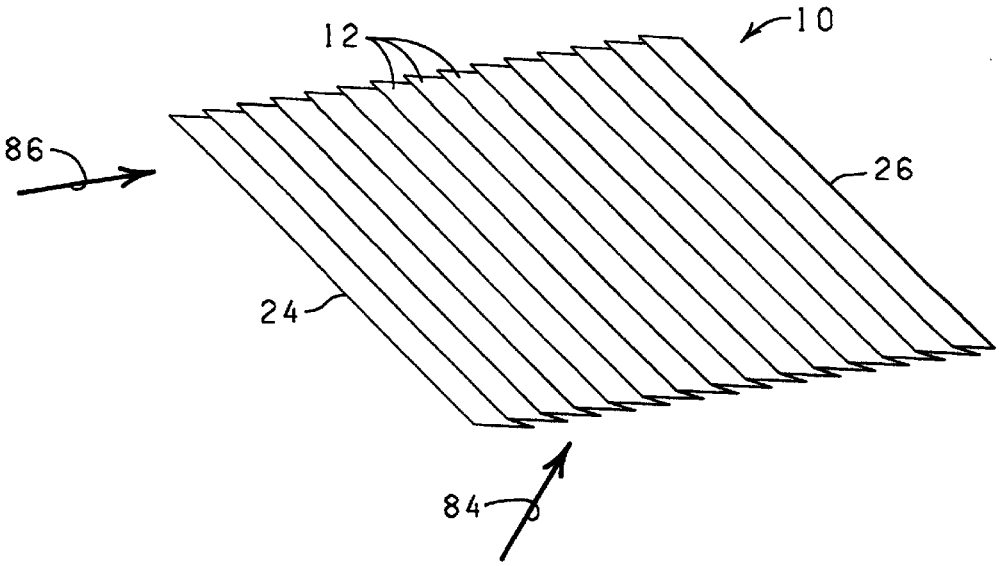
FIG. 1A is a perspective view of a sheet of folded corrugated material constructed in accordance with the present invention.

Referring now to FIG. 1, designated generally by the reference numeral 10 is a sheet of folded corrugated material. The sheet of folded corrugated material 10 has a plurality of folds 12 substantially as shown. As will be more fully described in detail hereinafter, each of the folds 12 has a first leg or segment 14 and a second leg or segment 16 which extend from a crease 18 of the fold 12, the crease 18 defining a fold line of the fold 12. The first leg or segment 14 has a length 20 (FIG. 2B), and the second leg or segment 16 has a length 22 (FIG. 2B) which is either greater than or less than the length 20 of the first leg or segment 14 of the fold 12. That is, if the length 20 of the first leg or segment 14 is greater than the length 22 of the second leg or segment 16 of the fold 12, each of the folds 12 tends to overlay a portion of an adjacent fold 12 such that the folds 12 extend in the direction of a first end 24 of the sheet of folded corrugated material 10 as shown in FIG. 1A. On the other hand, if the length 20 of the first leg or segment 14 is less than the length 22 of the second leg or segment 16 of the fold 12, each of the folds 12 tends to overlay a portion of an adjacent fold 12 such that the folds 12 extend in the direction of a second end 26 of the sheet of folded corrugated material 10.

The length of the first and second legs or segments 14 and 16 of the folds 12 can vary widely and will generally depend on the shingle effect and appearance desired in the sheet of folded corrugated material 10. Generally, however, it is desirable that the lengths 20 and 22 of the first and second legs or segments 14 and 16, respectively, be such so that when the folds 12 are formed, the overlaying folds 12 cover at least about 55 percent of the surface area of the adjacent underlying folds 12, and more desirably at least about 90 percent of the surface area of the adjacent underlying folds 12.

Figure 1B:
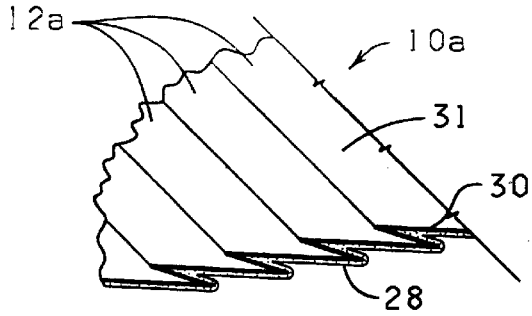
FIG. 1B is a fragmental perspective view of a sheet of folded corrugated material constructed in accordance with the present invention having a bonding material disposed on at least a portion of a lower side thereof.

Referring now to FIG. 1B, designated generally by the reference numeral 10*a* is a portion of a sheet of folded corrugated material. The sheet of folded corrugated material 10*a* has a plurality of folds 12*a* and the sheet of folded corrugated material 10*a* is substantially identical in construction to the sheet of folded corrugated material 10 herein before described except that a bonding material 28 is disposed on at least a portion of one or both surfaces of the sheet of folded corrugated material 10*a*, such as a lower surface 30 thereof.

Figure 3A:
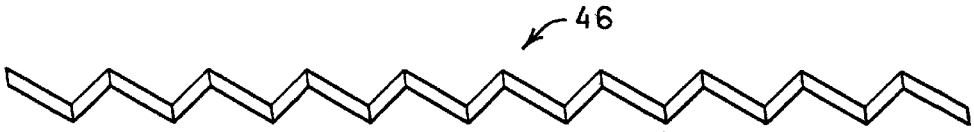
FIG. 3A is a perspective view of a decorative segment produced from the sheet of folded corrugated material of FIG. 1A when the sheet of folded corrugated material is cut at an angle to a fold line of the folds.
Figure 3B:
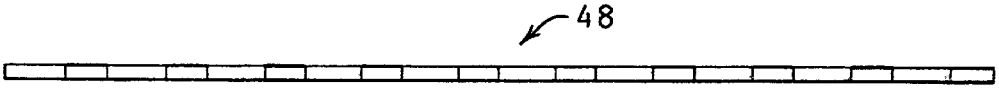
FIG. 3B is a top plan view of a decorative segment produced from the sheet of folded corrugated material of FIG. 1A when the sheet of folded corrugated material is cut transversely to a fold line of the folds.

The folded corrugated sheets of material 10 and 10*a* can be produced from a sheet or web of substantially flat material 32 (see FIG. 2A) that is capable of being creased and folded to form the folded corrugated material 10 or 10*a*, and which can be employed to provide decorative segments for use as Easter grass or a packing material (FIGS. 3A and 3B). Examples of such material are paper (untreated or treated in any manner), foil, polymeric film (including synthetic polymeric films and naturally occurring polymeric films, such as cellophane) or any combination thereof, including laminates such as paper and polymeric film laminates, polymeric film laminates, foil and paper laminates, foil and polymeric film laminates and the like.

The sheet or web of substantially flat material 32 may also vary in color. Further, the sheet or web of substantially flat material 32 may consist of designs or patterns which are printed, etched, and/or embossed on at least a portion of one surface of the sheet or web of substantially flat material 32; and in addition, the sheet or web of substantially flat material 32 may have various colorings, coatings, flockings, and/or metallic finishes thereon, or be characterized totally or partially by pearlescent, translucent, transparent, iridescent, or the like characteristics. Each of the above-named characteristics may occur alone or in combination.

At least a portion of one surface of the sheet or web of substantially flat material 32 may be modified to provide the sheet or web of substantially flat material 32 with a matte or textured finish simulating the appearance or texture of cloth. The modification of the sheet or web of substantially flat material 32 to provide the matte or textured finish simulating the appearance or texture of cloth can be accomplished in several ways. For example, a matte finish can be provided by printing a desired pattern on at least a portion of one surface of the sheet or web of substantially flat material 32 and thereafter laminating a matte material, such as a translucent polymeric film, over the printed pattern. To further enhance the cloth-like appearance of the sheet or web of substantially flat material 32, the matte material may or may not have a plurality of spatially disposed holes extending therethrough. The matte or textured finish simulating the appearance or texture or cloth can also be produced by printing at least a portion of one surface of the sheet or web of substantially flat material 32 with a matted (i.e. dull finish) ink, by lacquering at least a portion of one surface of the sheet or web of substantially flat material 32 with a dull finish lacquer or a matting lacquer, by embossing the sheet or web of substantially flat material 32 to provide an embossed pattern simulating the weave or texture of cloth, or by embossing and printing the sheet or web of substantially flat material 32 to provide embossed and printed patterns, wherein the embossed and printed patterns may be in registry, out of registry, or wherein a portion of the embossed and printed patterns are in registry and a portion of the embossed and printed patterns are out of registry. In addition, a matte or textured finish capable of providing the sheet or web of substantially flat material 32 with a cloth-like appearance can be achieved by extruding a resin onto a matted or textured chill roll or by laminating a second sheet of material to the sheet or web of substantially flat material 32.

The sheet of folded corrugated material 10 or 10*a* can be of any shape, configuration or size as long as the sheet of folded corrugated material 10 or 10*a* is sufficiently sized and shaped to form decorative grass. That is, the sheet of folded corrugated material 10 or 10*a* may have a square, rectangular, round, oval, octagonal or asymmetrical shape. Further, multiple sheets of the folded corrugated material 10 or 10*a* may be used in a single circumstance to provide decorative grass. Moreover, when multiple sheets or webs of substantially flat of material 32 are used to form the folded corrugated material 10 or 10*a*, the sheets or webs of substantially flat material 32 need not be uniform in size or shape.

The thickness or stiffness of the sheet or web of substantially flat material 32 employed in the production of the sheets of folded corrugated materials 10 and 10*a* can vary widely as long as the sheet of folded corrugated material 10 or 10*a* can be cut to produce decorative grass, as described herein. Generally, the sheet of folded corrugated material 10 or 10*a* will have a thickness of from about 0.1 mil to about 30 mil, and more desirably a thickness of from about 0.5 mil to about 2.5 mil.

Figure 2A:
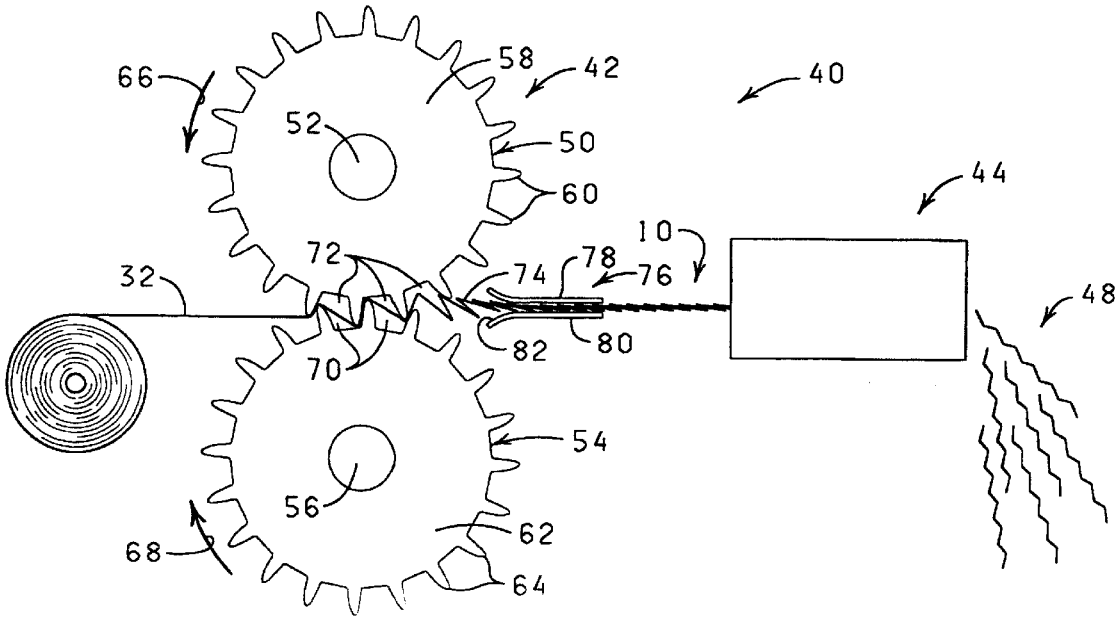
FIG. 2A is a schematic representation of a system for producing the sheets of folded corrugated material of FIGS. 1A and 1B having a shredding assembly associated therewith for cutting the sheets of folded corrugated material into decorative segments.
Figure 2B:
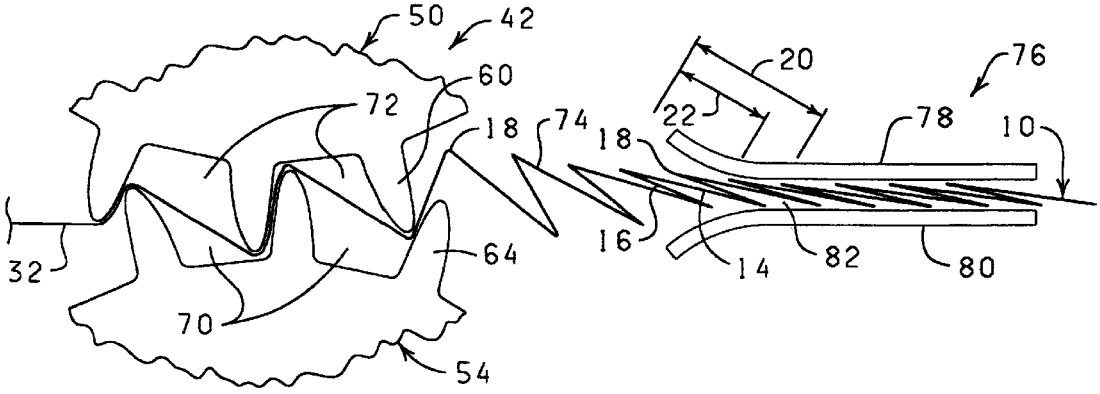
FIG. 2B is an enlarged fragmental view of a corrugating assembly and a folding assembly of the system of FIG. 2A for producing the sheets of folded corrugated material of FIGS. 1A and 1B.
Figure 2C:
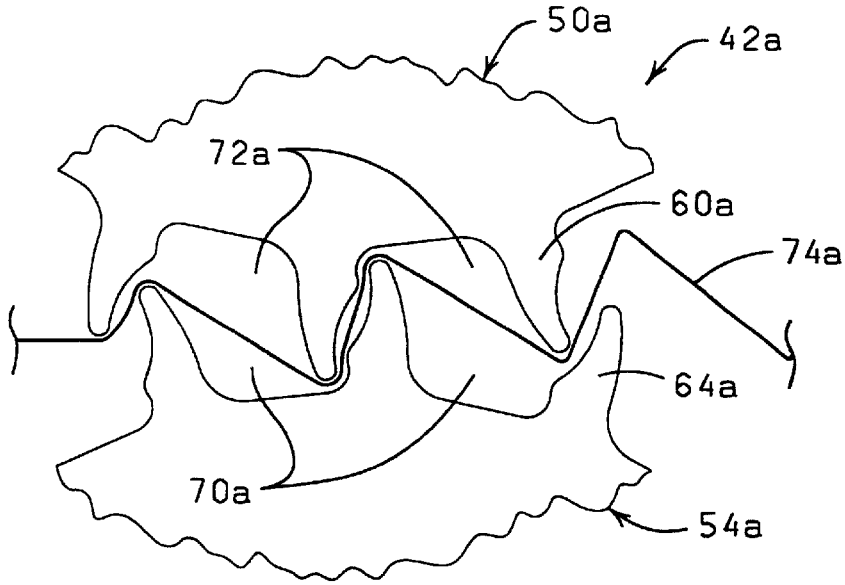
FIG. 2C is an enlarged fragmental view of another embodiment of a corrugating assembly for use in the system of FIG. 2A.

Referring now to FIGS. 2A–2C, designated generally by the reference numeral 40 is a system for producing the sheet of folded corrugated material 10 from the sheet or web of substantially flat material 32. The system 40, which includes a corrugating assembly 42, is shown as including a shredding assembly 44 for cutting the sheet of folded corrugated material 10 produced by passage of the sheet or web of substantially flat material 32 through the corrugating assembly 42 into segments or strips of material, such as the segments or strips of material 46 and 48 as illustrated in FIGS. 3A and 3B, respectively. The segments or strips of material 46 and 48 can be used as a decorative grass (i.e. Easter grass) or as an animal bedding material, cat litter, a mulch or a media for plants.

It should be noted that when using the sheet of folded corrugated material 10 produced from the sheet of the substantially flat material 32, the shredding assembly 44 may only be required to cut the sheet of folded corrugated material 10 into strips of material which have a length determined by the dimensions of the sheet of folded corrugated material 10. However, when the sheet of folded corrugated material 10 is produced from a web of substantially flat material 32, the shredding assembly 44 comprises a slitting unit for slitting the folded corrugated material 10 and a cutting or chopper unit for cutting the slit folded corrugated material into segments.

Referring more specifically to FIGS. 2A and 2B, the corrugating assembly 42 comprises a first corrugation forming member 50 rotatably mounted on a shaft 52 and a second corrugation forming member 54 rotatably mounted on a shaft 56. The first corrugation forming member 50 is provided with a body member 58 having a substantially circular cross-sectional configuration and a plurality of outwardly extending, equally spaced finger members or teeth 60 extending therefrom so as to be disposed about the periphery of the body member 58 substantially as shown. The second corrugation forming member 54 is likewise provided with a body member 62 having a substantially circular cross-sectional configuration and a plurality of outwardly extending, equally spaced finger members or teeth 64 disposed about the periphery of the body member 62 substantially as shown. The first and second corrugation forming members 50 and 54 are mounted such that, upon rotation of the first corrugation forming member 50 in a counterclockwise direction as indicated by the arrow 66 and rotation of the second corrugation forming member 54 in a clockwise direction as indicated by the arrow 68, the finger members or teeth 60 of the first corrugation forming member 50 are positionable in recesses 70 formed between the finger members or teeth 64 of the second corrugation forming member 54, and the finger members or teeth 64 of the second corrugation forming member 54 are positionable within recesses 72 formed between the finger members or teeth 60 of the first corrugation forming member 50 substantially as shown. The rotation of the first and second corrugation forming members 50 and 54 on the shafts 52 and 56, respectively, is such that the finger members or teeth 60 of the first corrugation forming member 50 are offset relative to the recesses 70 formed between the finger members or teeth 64 of the second corrugation forming member 54 and the finger members or teeth 64 of the second corrugation forming member 54 are offset relative to a central point of the recesses 72 formed between the finger members or teeth 60 of the first corrugation forming member 50. Further, the first and second corrugation forming members 50 and 54 are spatially disposed sufficient to permit passage of the sheet or web of substantially flat material 32 therebetween during the formation of corrugations therein. By changing the timing, i.e., the position of the finger members or teeth 60 of the first corrugation forming member 50 relative to the recesses 70 of the second corrugation forming member 54, the finger members or teeth 60 of the first corrugation forming member 50 are positioned closer to one side of the finger members or teeth 64 of the second corrugation forming member 54 such that upon passage of the sheet or web of substantially flat material 32 therebetween, the crease 18 is formed in the sheet or web of substantially flat material 32 and the finger members or teeth 60 and 64 of the first and second corrugation forming members 50 and 54 together with movement of the sheet or web of substantially flat material 32 through the recesses 72 and 70 of the first and second corrugation forming members 50 and 54, respectively, create a substantially 90 degree bend in the sheet or web of substantially flat material 32 and thereby produces a corrugated sheet or web of material 74. As previously stated, passage of the sheet or web of substantially flat material 32 between the first and second corrugation forming members 50 and 54 produces the corrugated sheet or web of material 74 wherein one leg of each corrugation or fold is provided with a length greater than the length of the second leg of each corrugation substantially as shown in FIG. 2B.

Any suitable apparatus can be employed as the first and second corrugation forming members 50 and 54 which are capable of forming a crease and a bend in the sheet or web of substantially flat material 32 as same passes between the first and second corrugation forming members 50 and 54. For instance, the first and second corrugation forming members 50 and 54 can be spur gears which are modified such that the distal end of each of the teeth of the spur gears forms a single crease in the sheet or web of substantially flat material 32 when same is passed between the first and second corrugation forming members 50 and 54, and such gears can be driven by the shafts 52 and 56 which are connected to two helical gears which are capable of changing the timing of the spur gears in order to obtain the desired relationship between the first and second corrugation forming members 50, 54 so as to produce the corrugated sheet or web of material 74 wherein one leg of each corrugation is longer than the other leg of each corrugation.

To enhance folding of the corrugations of the corrugated sheet or web of material 74 to provide the sheet of folded corrugated material 10 or 10*a* (as shown in FIGS. 1 and 1A) wherein each of the folds overlays an adjacently disposed fold, the system 40 further includes a folding assembly 76. The folding assembly 76 comprises a pair of spatially disposed arm members 78 and 80 defining a passageway 82 there-between. Thus, as the corrugated sheet or web of material 74 is drawn between the first and second corrugation forming members 50 and 54 and fed into the passageway 82 formed between the first and second arm members 78, 80 of the folding assembly 76, the corrugations of the corrugated sheet or web of material 74 are caused to fold over one another so that each of the folds overlays an adjacently disposed fold and produces the sheet of folded corrugated material 10 or 10*a* illustrated in FIGS. 1A and 1B.

The sheet of folded corrugated material 10 or 10*a* can then be fed through the shredding assembly 44 wherein the sheet of folded corrugated material 10 or 10*a* is cut into strips or segments of material 46, 48 having a predetermined width and length to produce decorative grass segments 46 (FIG. 3A or decorative grass segments 48 (FIGS. 2A and 3B).

To produce the segments of material 46 depicted in FIG. 3A which has a three-dimensional configuration, the sheet of folded corrugated material 10 or 10*a* is cut in an angular direction relative to the fold line of the folds 12 or 12*a* (i.e. obliquely to the machine direction), as indicated by the arrow 84 in FIG. 1A. The degree of angle at which the sheet of folded corrugated material 10 or 10*a* is cut to produce the segments of material 46 can vary widely but generally will be about 45 degrees. On the other hand, to produce the segments of material 48 illustrated in FIG. 3B, the sheet of folded corrugated material 10 or 10*a* is cut transversely relative to the fold line of the folds 12 or 12*a*, i.e., in the machine direction, as indicated by the arrow 86.

Any conventional device and method can be employed as the shredding assembly 44 for slitting the sheet of folded corrugated material 10 or 10*a* into a plurality of strips of predetermined width and/or for cutting the strips of the sheet of folded corrugated material 10 or 10*a* to form the segments 46 or 48 of corrugated decorative grass in accordance with the present invention. Examples of conventional devices which can be used as the shredding assembly 44, including a device for slitting the sheet of folded corrugated material 10 or 10*a* and thereafter, if required, cutting the slit material into segments 46 or 48, are rotary knives, reciprocating knives, die cutting, laser cutting, water jet cutting, air jet cutting and the like.

Another embodiment of a corrugating assembly 42*a* is illustrated in FIG. 2C for producing a corrugated sheet or web of material 74*a* which, upon subsequent passage through the folding assembly 76, produces a sheet of folded corrugated material similar to the sheet of folded corrugated materials 10 and 10*a*. In this embodiment, the corrugating assembly 42*a* comprises a first corrugation forming member 50*a* and a second corrugation forming member 54*a* which are substantially identical in configuration and function as the first and second corrugation forming members 50 and 54 hereinbefore described with reference to the corrugating assembly 42, except for the configuration of finger members or teeth 60*a* and recesses 72*a* of the first corrugation forming member 50*a* and finger members or teeth 64*a* and recesses 70*a* of the second corrugation forming member 54*a*. With such exceptions, the corrugating assembly 42*a* is substantially identical to the corrugating assembly 42 hereinbefore described, as is its operation.

Figure 2D:
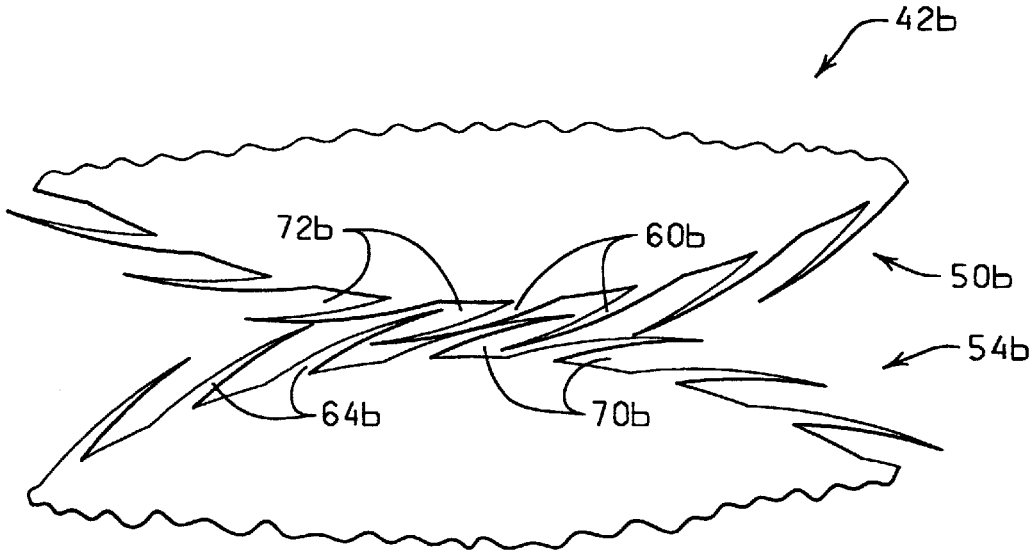
FIG. 2D is an enlarged fragmental view of yet another embodiment of a corrugating assembly for use in the system of FIG. 2A.

Another embodiment of a corrugating assembly 42*b* is illustrated in FIG. 2D for producing a corrugated sheet or web of material (not shown) which, upon subsequent passage through the folding assembly 76 produces a sheet of folded corrugated material similar to the sheets of folded corrugated material 10 and 10*a*. In this embodiment, the corrugating assembly 42*b* comprises a first corrugation forming member 50*b* and a second corrugation forming member 54*b* which are substantially identical in configuration and function as the first and second corrugation forming members 50 and 54 hereinbefore described with reference to the corrugating assembly 42, except for the configuration of finger members or teeth 60*b* and recesses 72*b* of the first corrugation forming member 50*b* and finger members or teeth 64*b* and recesses 70*b* of the second corrugation forming member 54*b*. With such exceptions, the corrugating assembly 42*b* is substantially identical to the corrugating assembly 42 hereinbefore described, as is its operation.

Figure 2E:
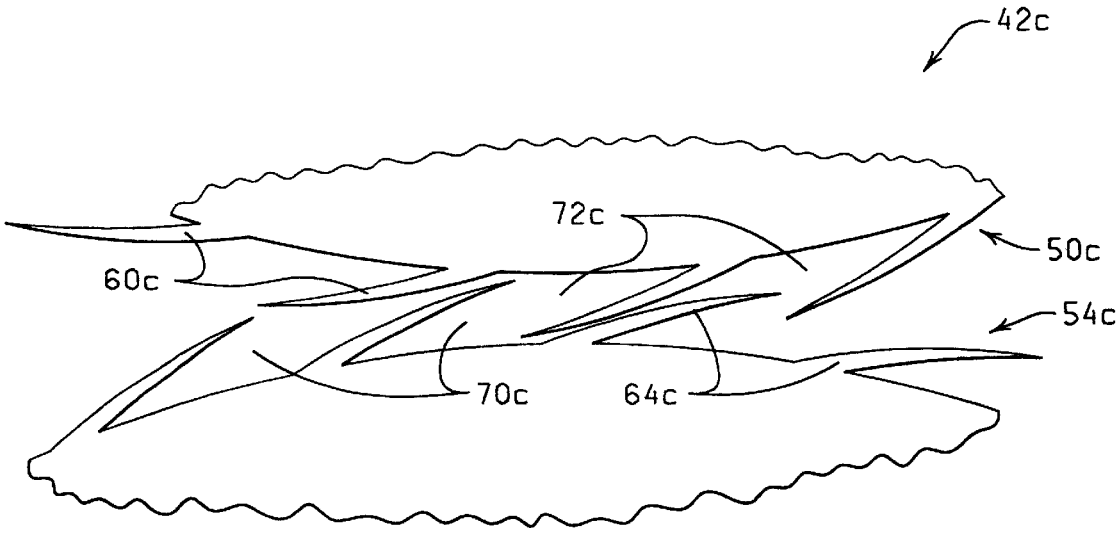
FIG. 2E is an enlarged fragmental view of yet another embodiment of a corrugating assembly for use in the system of FIG. 2A.

Another embodiment of a corrugating assembly 42*c* is illustrated in FIG. 2E for producing a corrugated sheet or web of material (not shown) which, upon subsequent passage through the folding assembly 76, produces a sheet of folded corrugated material similar to the sheets of folded corrugated materials 10 and 10*a*. In this embodiment, the corrugating assembly 42*c* comprises a first corrugation forming member 50*c* and a second corrugation forming member 54*c* which are substantially identical in configuration and function to the first and second corrugation forming members 50 and 54 hereinbefore described except for the configuration of finger members or teeth 60*c* and recesses 72*c* of the first corrugation forming member 50*c* and finger members or teeth 64*c* and recesses 70*c* of the second corrugation forming member 54*c*. With such exceptions, the corrugating assembly 42*c* is substantially identical to the corrugating assembly 42 hereinbefore described, as is its operation.

Figure 4:
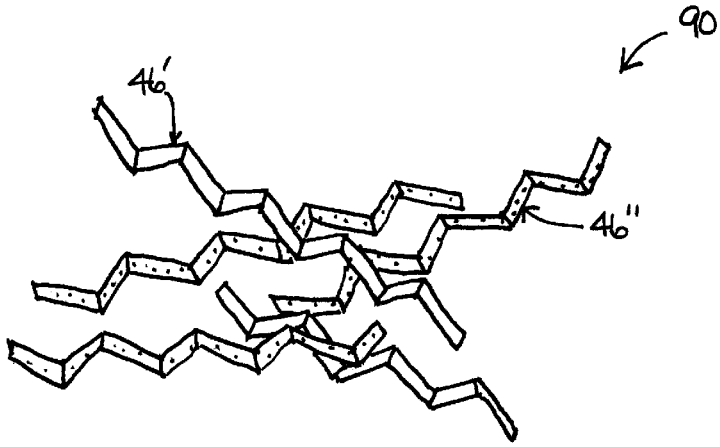
FIG. 4 is a perspective view of a corrugated decorative grass formed of segments of a first material and segments of a second material.

In one embodiment, the corrugated decorative grass of the present invention may comprise segments of a first material and segments of a second material which are mixed together to provide the corrugated decorative grass. The segments of a first material are formed from a sheet of folded corrugated material 10' (not shown), and the segments of a second material are formed from a sheet of folded corrugated material 10", wherein the sheets of folded corrugated material 10' and 10" are substantially identical to the sheet of folded corrugated material 10 described in detail herein before. The sheets of folded corrugated material 10' and 10" are each separately cut into segments by the system 40 described herein previously, and the sheet of folded corrugated material 10' produces segments 46' or 48' while the sheet of folded corrugated material 10" produces segments 46" or 48". Following formation of the segments 46' or 48' and segments 46" or 48", such segments 46' or 48' and segments 46" or 48" are mixed together to form a corrugated decorative grass 90 comprising a mixture of segments formed from the sheet of folded corrugated material 10' and the sheet of folded corrugated material 10" (FIG. 4).

For example, the sheet of folded corrugated material 10' may be constructed of paper, while the sheet of folded corrugated material 10" may be constructed of polymeric film, and the corrugated decorative grass 90 formed therefrom is a mixture of corrugated segments of paper and polymeric film.

While the corrugated decorative grass 90 has been described herein above as being formed from sheets of folded corrugated material 10' and 10" which are substantially identical to the sheet of folded corrugated material 10, it is to be understood that the corrugated decorative grass 90 may also be formed from sheets of folded corrugated material 10*a*' and 10*a*" (not shown) which are substantially identical to the sheet of folded corrugated material 10*a*, or the decorative grass 90 may be formed from a sheet of folded corrugated material substantially identical to the sheet of folded corrugated material 10 and a sheet of folded corrugated material substantially identical to the sheet of folded corrugated material 10*a*. For example, it may be desirable to provide bonding material on a portion of the segments formed from the first material and/or the segments formed from the second material such that segments of the different materials may be bondingly connected to one another.

Changes may be made in the construction and the operation of the various components, elements and assemblies described herein or in the steps or the sequence of steps of the methods described herein without departing from the spirit and scope of the invention as defined in the following claims.

What is claimed:

1. A method for producing corrugated decorative grass, comprising:

providing a sheet of paper capable of being folded;

providing a sheet of polymeric film capable of being folded;

folding the sheet of paper to provide a corrugated sheet of paper having a plurality of folds wherein each of the folds have a first leg and a second leg and each of the first and second legs of the folds extend from a crease of the fold;

folding the sheet of polymeric film to provide a corrugated sheet of polymeric film having a plurality of folds wherein each of the folds have a first leg and a second leg and each of the first and second legs of the folds extend from a crease of the fold;

cutting the corrugated sheet of paper having a plurality of folds to provide a plurality of corrugated segments of paper;

cutting the corrugated sheet of polymeric film having a plurality of folds to provide a plurality of corrugated segments of polymeric film; and mixing the corrugated segments of paper and the corrugated segments of polymeric film to form a corrugated decorative grass comprising corrugated segments of paper and corrugated segments of polymeric film.

2. The method of claim 1 wherein, in the step of providing a sheet of paper, at least a portion of one surface of the sheet of paper is provided with at least one of printed patterns, embossed patterns and combinations thereof.

3. The method of claim 1 wherein, in the step of providing a sheet of polymeric film, at least a portion of one surface of the sheet of polymeric film is provided with at least one of printed patterns, embossed patterns and combinations thereof.

4. The method of claim 1 wherein, in the step of folding the sheet of paper to provide a corrugated sheet of paper having a plurality of folds, one of the first and second legs of each of the plurality of folds is provided with a length greater than the other leg so that the folds overlay a portion of an adjacent fold.

5. The method of claim 1 wherein, in the step of folding the sheet of polymeric film to provide a corrugated sheet of polymeric film having a plurality of folds one of the first and second legs of each of the plurality of folds is provided with a length greater than the other leg so that the folds overlay a portion of an adjacent fold.

6. The method of claim 1 wherein, in the step of cutting the corrugated sheet of paper, the corrugated sheet of paper is cut in an angular direction relative to a fold line of the folds so as to produce corrugated segments of paper having a three dimensional configuration.

7. The method of claim 6 wherein the angular direction at which the corrugated sheet of paper is cut relative to the fold line of the folds is about 45 degrees.

8. The method of claim 1 wherein, in the step of cutting the corrugated sheet of paper, the corrugated sheet of paper is cut transversely to a fold line of the folds.

9. The method of claim 1 wherein, in the step of cutting the corrugated sheet of polymeric film, the corrugated sheet of polymeric film is cut in an angular direction relative to a fold line of the folds so as to produce corrugated segments of polymeric film having a three dimensional configuration.

10. The method of claim 9 wherein the angular direction at which the corrugated sheet of polymeric film is cut relative to the fold line of the folds is about 45 degrees.

11. The method of claim 1 wherein, in the step of cutting the corrugated sheet of polymeric film, the corrugated sheet of polymeric film is cut transversely to a fold line of the folds.

12. The method of claim 1 wherein, in the step of providing the sheet of paper, at least a portion of one surface of the sheet of paper is provided with a matte or textured finish simulating the appearance or texture of cloth.

13. The method of claim 1 wherein, in the step of providing the sheet of polymeric film, at least a portion of one surface of the sheet of polymeric film is provided with a matte or textured finish simulating the appearance or texture of cloth.

14. The method of claim 1 wherein, in the step of providing the sheet of paper, the sheet of paper is provided with a thickness in a range of from about 0.1 mil to about 30 mil.

15. The method of claim 1 wherein, in the step of providing the sheet of polymeric film, the sheet of polymeric film is provided with a thickness in a range of from about 0.1 mil to about 30 mil.

* * * * *